United States Patent [19]

Bunker

[11] 3,935,633

[45] Feb. 3, 1976

[54] TANK FABRICATION PROCESS

[76] Inventor: Jack E. Bunker, 108 E. Ash, Winfield, Iowa 52659

[22] Filed: Apr. 16, 1974

[21] Appl. No.: 461,456

[52] U.S. Cl. ..... 29/559; 29/462; 113/120 R

[51] Int. Cl.[2] ..... B23Q 7/00

[58] Field of Search ..... 29/469, 559, 462, 464, 29/200 J; 72/379; 113/120 R, 116 QA, 116 V, 116 Y, 1 N

[56] References Cited

UNITED STATES PATENTS

| | | | |
|---|---|---|---|
| 2,988,810 | 6/1961 | Wilken | 29/462 X |
| 3,237,295 | 3/1966 | Konzak | 29/200 J X |
| 3,340,101 | 9/1967 | Fields, Jr. et al. | 148/11.5 |
| 3,718,021 | 2/1973 | Shein | 72/126 |
| 3,718,803 | 2/1973 | Evans | 219/158 |
| 3,747,551 | 7/1973 | Bennekers | 29/462 X |

*Primary Examiner*—Victor A. DiPalma
*Attorney, Agent, or Firm*—Clarence A. O'Brien; Harvey B. Jacobson

[57] ABSTRACT

Containers such as tanks, bins, cylinders, and the like, are constructed from a plurality of arcuate sections. The sections are formed on the ground, or other support surface, and lifted therefrom in a suitable manner to cooperate with other like sections during erection of the containers. Each section is formed by a plurality of strips laid on a concave jig so as to conform thereto. Beams reinforce the strips, which are tied together as by welds, and the like, to form a sheet. Shapers are advantageously removably attached to the sections for holding same to a required shape until the sections are connected together, and for holding adjacent sections in position relative to one another until suitable connection between the sections is made.

2 Claims, 17 Drawing Figures

TANK FABRICATION PROCESS

BACKGROUND OF THE INVENTION

1. Field of the Invention

This invention relates generally to container construction, and particularly to the erection of, for example, steel grain bins, tanks, and cylinders.

2. Description of the Prior Art

A conventional method of erecting storage containers for grain, liquids, and other bulk materials employs factory fabrication of formed. punched, steel sections. These sections are expensive to fabricate, and leave something to be desired as regards rigidity and strength.

Another present method of erecting bulk storage containers involves welding steel plates in place on the container being erected. These plates are shaped above ground, a difficult and inefficient procedure.

A disadvantage to any known bulk storage container erection technique is the amount of handling required of the steel plates used to construct the container. These plates are heavy, and any transport and manipulation of the plates reduces the efficiency of the process.

SUMMARY OF THE INVENTION

It is an object of the present invention to provide an improved technique for manufacturing and erecting bulk storage containers.

It is another object of the present invention to provide an improved technique for forming and shaping container sections on the ground and adjacent a construction site.

It is still another object of the present invention to provide a shaper for holding a container section to a predetermined shape until the section is affixed to other container structure.

These and other objects are achieved according to the present invention by providing a container comprising a plurality of sections, each section having a reinforced arcuate sheet formed by placing one or more strips of plate material on a concave jig and permitting the weight of the material to conform the plate to the concavity of the jig.

The sections are preferably, but not necessarily, formed from a plurality of strips arranged in overlapping relationship along a longitudinal extent of the jig. Beams, and the like, may be arranged on the attached strips for properly reinforcing same.

A shaper is advantageously removably mounted on the preformed sections for holding same to a required shape until the sections are connected together. A preferred embodiment of this shaper includes an arcuate frame provided with a fastening arrangement for removably securing the frame to an associated section and with an arrangement for releasably locking the frame to a frame of the shaper associated with an adjacent container section.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
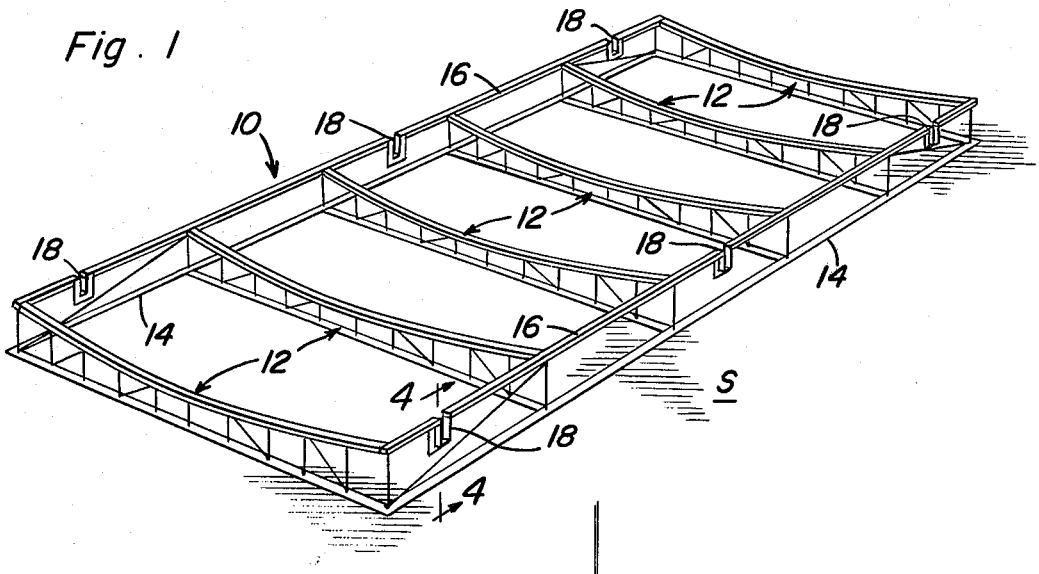
FIG. 1 is a schematic, perspective view showing a jig suitable for forming container sections according to the present invention.

Referring now more particular to FIG. 1 of the drawings, a jig 10 is formed by a plurality of substantially parallel, although spaced, concave girders 12 tied together by stringers 14 and 16. The latter stringers are provided with recesses 18 for receiving shapers to be described below. The details of the construction of recesses 18 are shown in FIG. 4 of the drawings.

Figure 2:
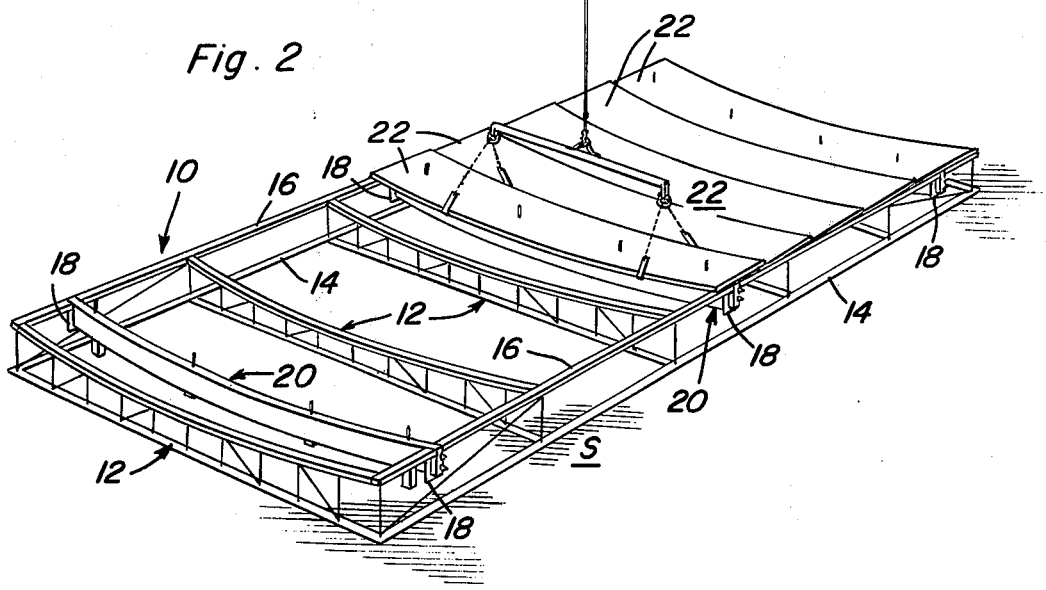
FIG. 2 is a schematic, perspective view similar to FIG. 1, but showing several strips arranged in overlapping relationship on the jig.
Figure 5:
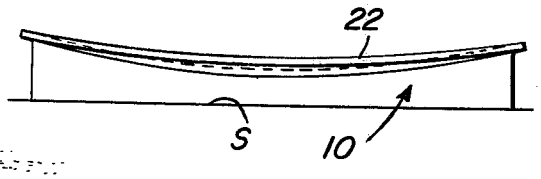
FIG. 5 is a schematic, end elevational view showing the manner in which the strips arranged on the jig conform to the concavity of the latter.
Figure 8:
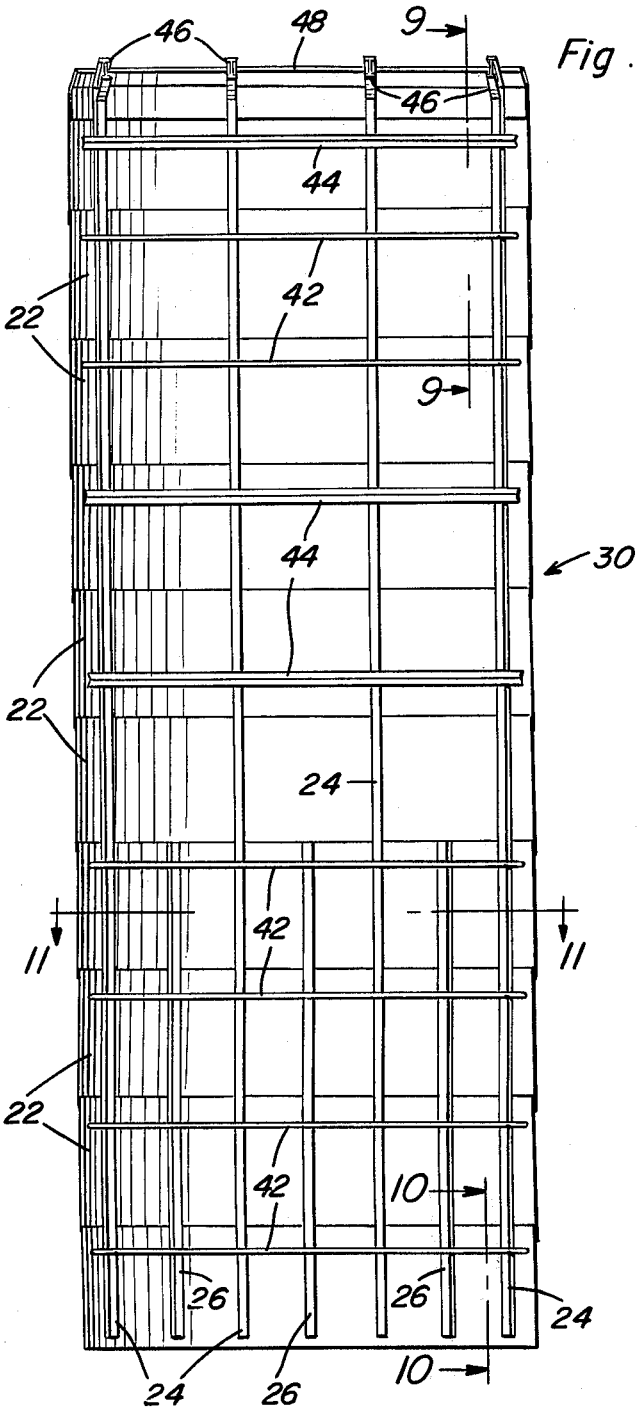
FIG. 8 is a rear elevational view showing the addition of stringers and tie bars facilitating attachment of a container section according to the present invention to other like sections.

Shapers 20 are removably mounted in recesses 18 as can best be seen in FIG. 2 of the drawings for holding the container sections to be constructed to a required shape until the sections are connected together. The shapers 20 are removably secured to associated ones of strips 22 arranged on jig 10 to form the container section, and are provided with an arrangement for releasably locking a respective shaper to an adjacent shaper until the container sections are connected together. Strips 22 are arranged in overlapping fashion on jig 10 to form an arcuate sheet which will become a portion of the skin of a resulting container. Placement of strips 22, which are desirably of a heavy material such as steel, on jig 10 permits the weight of strips 22 to conform to the concavity provided by the girders 12. Once strips 22 are properly arranged on jig 10 and have bent under their own weight so as to conform to the concavity of the jig, they are attached to one another in a suitable, known manner, such as by welding. FIG. 5 best illustrates the bending of strips 22 to conform to the concave surfaces of girders 12.

Figure 3:
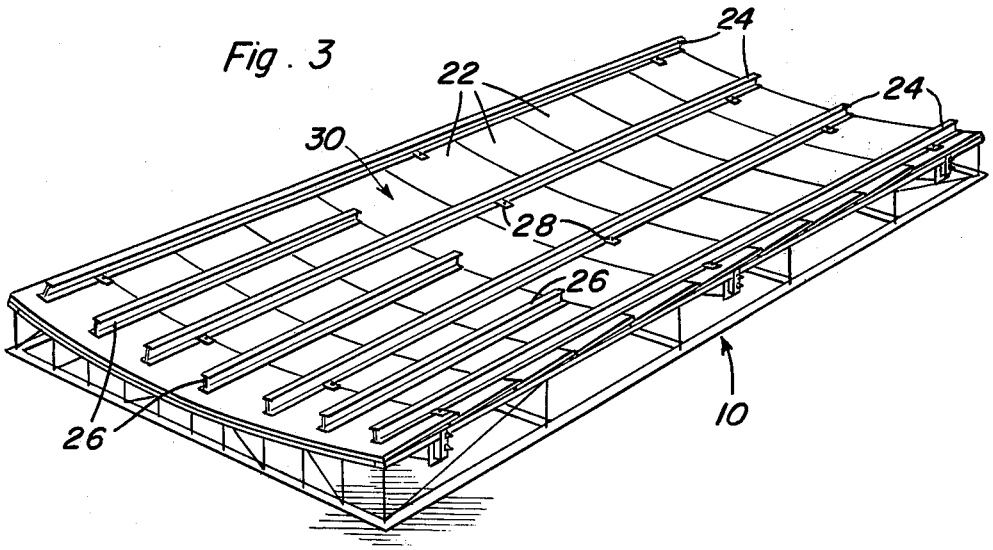
FIG. 3 is a schematic, perspective view similar to FIGS. 1 and 2, but showing a completed container section arranged on the jig.

Referring now to FIG. 3 of the drawings, beams 24 and 26 are advantageously attached to the sheet resulting from the combination of strips 22 for reinforcing the sheet. As can readily be seen from FIG. 3, beams 24 extend substantially the entire longitudinal length of the sheet, while beams 26 extend only a part of the longitudinal sheet length. The position of the shorter set of beams 26 permits additional reinforcing as desired. Beams 24 and 26 are arranged alternating with one another on the sheet as shown. Reference numeral 28 designates a fastener arrangement which permits attachment of shapers 20 to the section 30 resulting from the typing together of strips 22 and provision of beams 24 and 26. The finished section 30 is now ready to be lifted onto a container being erected.

Figure 4:
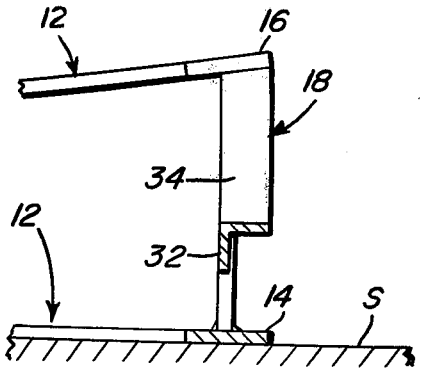
FIG. 4 is a fragmentary, sectional view taken generally along the line 4—4 of FIG. 1, but drawn to a larger scale.

FIG. 4 shows a preferred construction of a recess 18. An angle member 32 forms the sill of the recess, with a pair of side walls 34 being connected to member 32 and arranged extending vertically therefrom for providing the recess with width. The upper ends of walls 34 are connected to respective portions of a stringer 16. Only one of the side walls 34 is shown in FIG. 4 for reasons of clarity.

Figure 6:
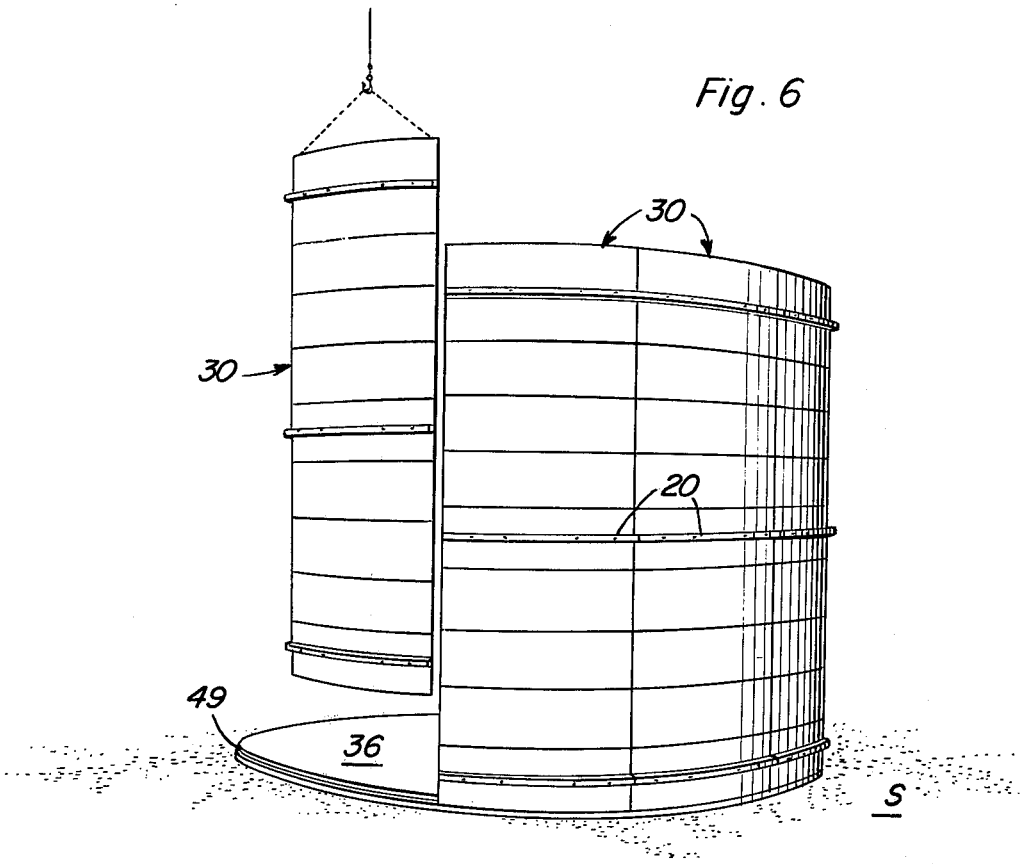
FIG. 6 is a schematic, perspective view showing a stage in the erection of a container being constructed with sections according to the present invention.
Figure 7:
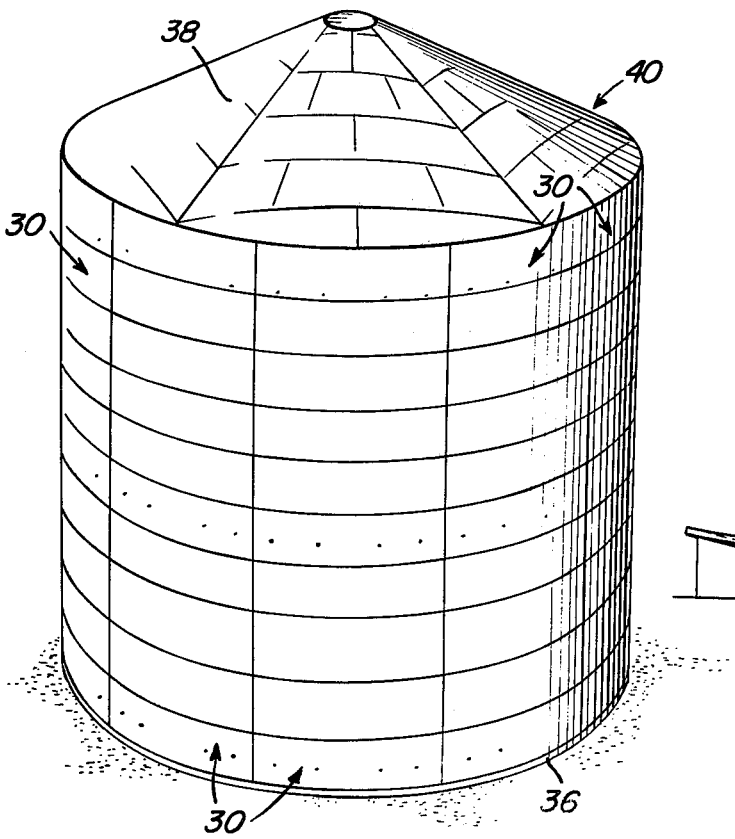
FIG. 7 is a schematic, perspective view showing a completed container constructed in accordance with the present invention.

Referring now to FIGS. 6 and 7 of the drawings, sections 30 are lifted in a suitable manner, such as by a conventional crane (not shown) onto a, for example, concrete base 36 constructed in a conventional manner on a suitable supporting surface S, such as the ground. After a sufficient number of sections 30 are mounted on base 36, and on one another in a manner not shown to increase the height of the resulting container, a roof 38 caps off the structure to form a, for example, tank 40.

FIGS. 8 through 11 of the drawings show the inner face of a section 30 when it has been provided with advantageous features according to the present invention. Essentially, a plurality of stringers 42 are arranged transversely of beams 24 and 26 together with a plurality of angle members forming braces 44 for holding the sheet to the specified concave curvature and to further rigidify section 30. Stringers 42 and braces 44 may be attached to beams 24 and 26 in any suitable, known manner, such as by welding. Advantageously, base 36 includes a, for example, steel anchor ring embedded therein for facilitating attachment of sections 30 to the base. This anchor ring is designated by the reference numeral 49 in FIG. 6 of the drawings. If additional sections 30 are to be arranged endwise with respect to a given tier of sections 30, for example, beams 24 and 26 may be connected to one another end-to-end to give strength to such a connection. Although this arrangement is not specifically illustrated in the drawings, it will be readily understood and appreciated. When a roof 38 is to be attached to a section 30, that section is advantageously provided with cantilever extensions 46 arranged extending from beams 24 at a predetermined angle with respect thereto for forming an anchor to which suitable rafters (nor shown) may be attached. Properly shaped plates may then be attached to the rafters for forming a covering for a roof 38. Angled corner sheets 48 may be arranged between strip 22 and the roof covering to finish off the roofside wall connection.

Referring now to FIGS. 12 through 17 of the drawings, each shaper 20 forms a shaper section having an arcuate frame 50. Passages 52 are provided in frame 50 as by arranging a sleeve between opposed ones of one of the two pairs of walls forming frame 50, and threaded bolts 54 are arranged in passages 52 so as to pass through holes 56 provided in strips 22 (see FIGS. 2 and 3 of the drawings) and retain the strips 22 to frame 50 as by a suitable retaining device. Nuts 58 are illustrated as performing the retaining function. Bolt 54 and nut 58 form a part of fastener arrangement 28 together with a plate washer 60 and a bar 62. See FIG. 14 of the drawings. Specifically, the dimension of bar 62 that is critical is the one which will correspond to the thickness of a flange of one of the I-beams 24. In this manner, washer 60 can extend between a flange of beam 24 to bar 62 and provide a stable bearing surface for nut 58. It is contemplated that, for example, 6 and 8 inch Junion I-beams will be satisfactory, depending on the size of the tank being constructed. Plate washers 60 of, for example, 3 × 3 × ½ inch plate with a 3/16 inch bar 62 1 × 3 inch welded to washer 60 on one edge thereof to compensate for the thickness of the I-beam flange so that washer 60 will be in a level position to accommodate nut 58 has been found satisfactory. It is to be understood, of course, that the leveling of washer 60 could be done in some other manner, but the illustrated arrangement is that preferred.

Figure 14:
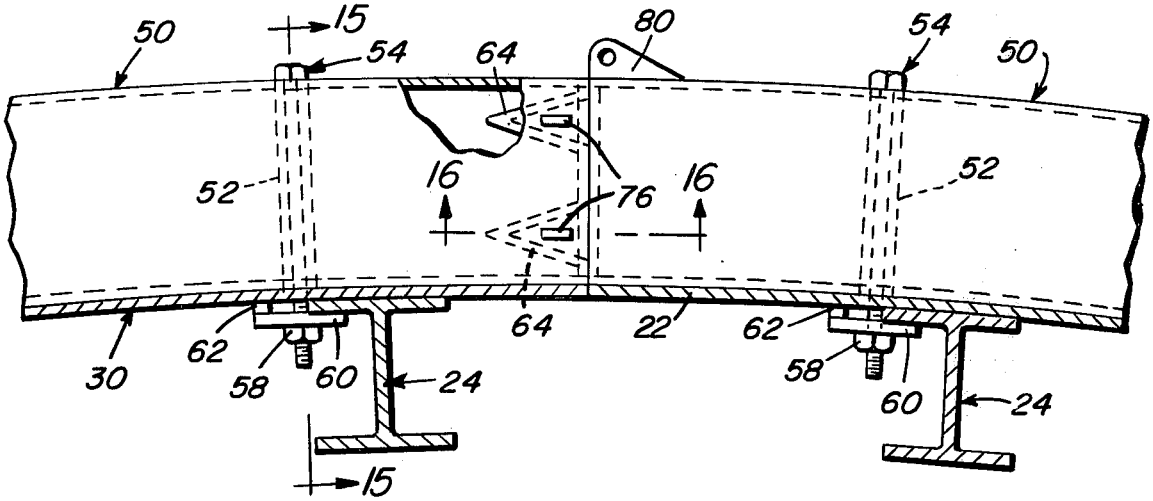
FIG. 14 is a fragmentary, plan view, partly in section, showing the attachment of a shaper according to FIGS. 12 and 13 to a container section according to the present invention.
Figure 15:
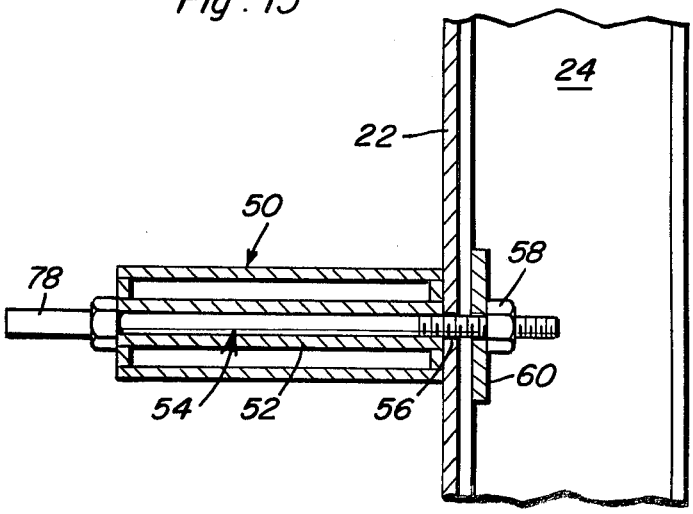
FIG. 15 is a fragmentary, sectional view taken generally along the lines 15—15 of FIG. 14, but with some parts removed.
Figure 17:
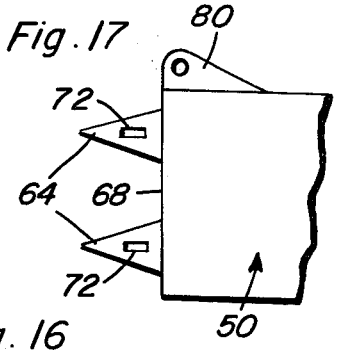
FIG. 17 is a fragmentary, plan view showing a detail of FIG. 14.
Figure 16:
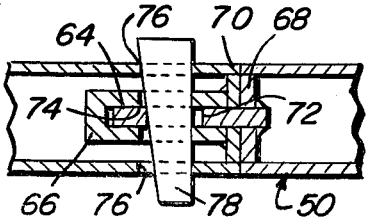
FIG. 16 is a fragmentary, sectional view taken generally along the line 16—16 of FIG. 14.

Projection 64 and cooperating socket 66 combine to form an arrangement for releasably locking one frame 50 to an adjacent frame 50 and hold the associated sections 30 in position until they can be affixed to one another. As can be readily seen from FIGS. 12 and 13 of the drawings, projection 64 and socket 66 are arranged in respective ends 68 and 70 of frame 50. Although a pair of projections and sockets are illustrated, it is to be understood that any number of such projections and mating sockets may be provided as desired and considered necessary. FIG. 14 of the drawings shows a pair of shapers 20 attached to one another by means of the projections 64 of the right-hand frame 50 being matingly engaged in the sockets 66 of the left-hand frame 50. The projections are retained in the sockets as by a releasable retaining arrangement including slots 72, 74, and 76 arranged in projections 64, sockets 66, and opposed walls of frame 50, respectively, for receiving a, for example, wedge 78. Arrangement of wedge 78 in the aforementioned slots prevents movement of the locked frames 50 toward and away from one another. Further, wedge 78 may be readily placed into the slots by simply inserting same therein once the slots are aligned, and the wedge may be easily removed by knocking same out of the slots.

A pair of lugs 80 are advantageously provided on the frame 50 of each shaper 20 to facilitate handling thereof. These lugs permit attachment of a hoisting frame as shown in FIG. 6 of the drawings. Further, to additionally decrease manual labor requirements, the strips 22 are advantageously placed onto jig 10 by the same crane (not shown) used to elevate the sections 30 to their positions in the container as by a suitable sling as shown in FIG. 2.

Figure 9:
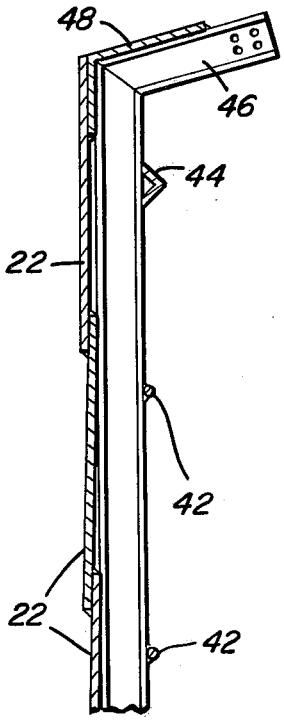
FIG. 9 is a fragmentary, sectional view taken generally along the line 9—9 of FIG. 8, but drawn to a larger scale.
Figure 10:
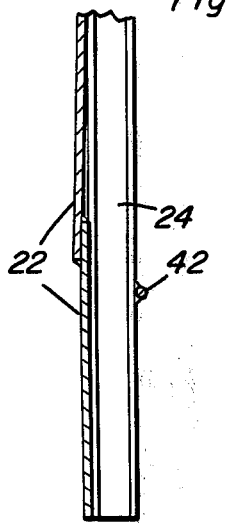
FIG. 10 is a fragmentary, sectional view taken generally along the line 10—10 of FIG. 8, but drawn to a larger scale.
Figure 11:
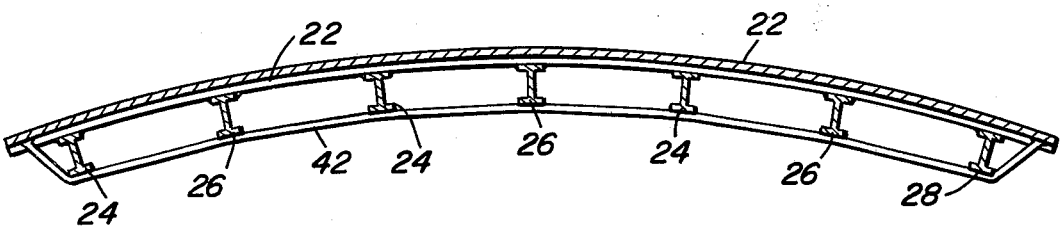
FIG. 11 is a sectional view taken generally along the line 11—11 of FIG. 8, but drawn to a larger scale.
Figure 12:
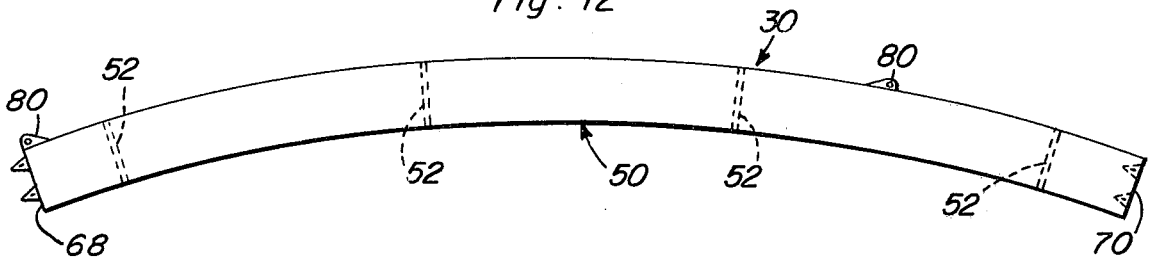
FIG. 12 is a plan view of a shaper according to the present invention.
Figure 13:
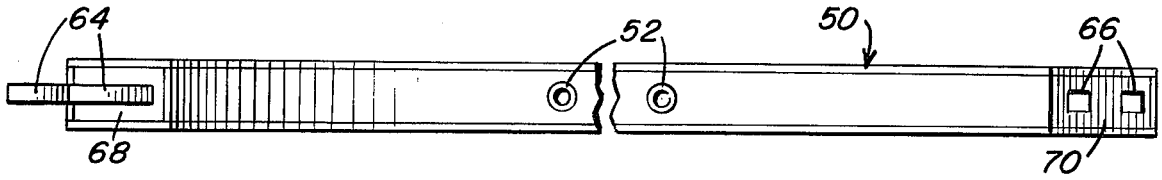
FIG. 13 is a front elevational view showing the shaper of FIG. 12.

As will be readily appreciated from the above description and from the drawings, for example, stock sheet steel is placed on jig 10 as shown in FIG. 2. The dimensions and the degree of concavity of girders 12 of jig 10 are dictated by the circumference of the tank or cylinder to be constructed. The weight of the steel causes it to take on the curvature of the jig. The stock is then clamped to the jig with, for example, conventional C-clamps. On smaller tanks it is sometimes necessary to apply pressure with wrenches as the weight of the steel is not sufficient to form the curvature. While the stock steel is clamped to the jig, I-beams are welded, as shown in FIG. 3, and bars and angle iron welded across the I-beams at right angles thereto, as shown in FIGS. 9 through 11. The I-beams, bars, and angle iron hold the stock steel to the specified concave curvature, and also form a rigid inner wall which allows the tank, even when empty, to withstand winds of gale force. The C-clamps may now be removed, and the section is erected with a crane as seen in FIG. 6. The section, when in place, is then welded to the steel anchor ring embedded in concrete base 36. Then the adjacent section is erected, and the process continues until the tank is completed. When the cylindrical side wall portion of the tank is completed, it is capped and the top or roof is welded in place.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

I claim:

1. A method for constructing a container comprising a skin formed of plates connected to each other in overlapping relation and having reinforcing beams, comprising the steps of:

a. placing a plurality of sheet strips in overlapping fashion on a jig having a semi-cylindrical concavity;

b. permitting the weight of the sheet strips to curve and conform the strips to the concavity and form an arcuate sheet;

c. attaching beams to the arcuate sheet for reinforcing the arcuate sheet; and d. connecting together of a plurality of reinforced arcuate sheets to form a generally cylindrical container.

2. A method as set out in claim 1, wherein the attaching step (c) includes the step of arranging the beams extending transverse of the curve of the strips.

* * * * *